United States Patent [19]

Davenport

[11] 4,382,701

[45] May 10, 1983

[54] WIRE MATRIX PRINTING APPARATUS

[75] Inventor: Keith B. Davenport, Sandhurst, England

[73] Assignee: International Computers Ltd., London, England

[21] Appl. No.: 267,444

[22] Filed: May 27, 1981

[51] Int. Cl.[3] ..... B41J 3/12

[52] U.S. Cl. ..... 400/124; 101/93.05

[58] Field of Search ..... 400/124; 101/93.05, 101/93.48

[56] References Cited

U.S. PATENT DOCUMENTS

| | | | |
|---|---|---|---|
| 3,434,413 | 3/1969 | Lee et al. | 101/93.34 |
| 4,051,941 | 10/1977 | Hebert | 400/124 |
| 4,079,824 | 3/1978 | Ku | 400/124 |
| 4,140,406 | 2/1979 | Wolf et al. | 400/124 |
| 4,165,940 | 8/1979 | Cacciola | 400/124 |
| 4,167,342 | 9/1979 | Mower et al. | 101/93.05 X |
| 4,258,623 | 3/1981 | Barrus et al. | 101/93.48 X |

*Primary Examiner*—Paul T. Sewell

*Attorney, Agent, or Firm*—Lee, Smith & Jager

[57] ABSTRACT

A wire matrix printing head moveable along a printing line on a record medium is described in which a ring of wire-selection electromagnets are grouped about the wire guiding arrangement, the electromagnets each having a basic yoke assembly with a pair of limbs each able to support a separate energising coil. The electromagnet armatures are supported by a common frame having a plurality of finger-like structures, one for each armature, on which the armatures are respectively pivoted. The printing wires are spring loaded into their restored positions and abut their respective armatures, which are supported in their respective unoperated positions each by an adjustable resilient backstop. The printing wires are supported in guides so that they are arranged in two columns, both the columnar pitch and the pitch of nominally adjacent wires in the columns being of the order of the wire diameter. Control of wire selection from the two columns is arranged to prohibit a further selection of any one wire for printing unless the printing head has moved along the printing line for a distance equal to twice the columnar pitch.

1 Claim, 4 Drawing Figures

WIRE MATRIX PRINTING APPARATUS

Figure 1:
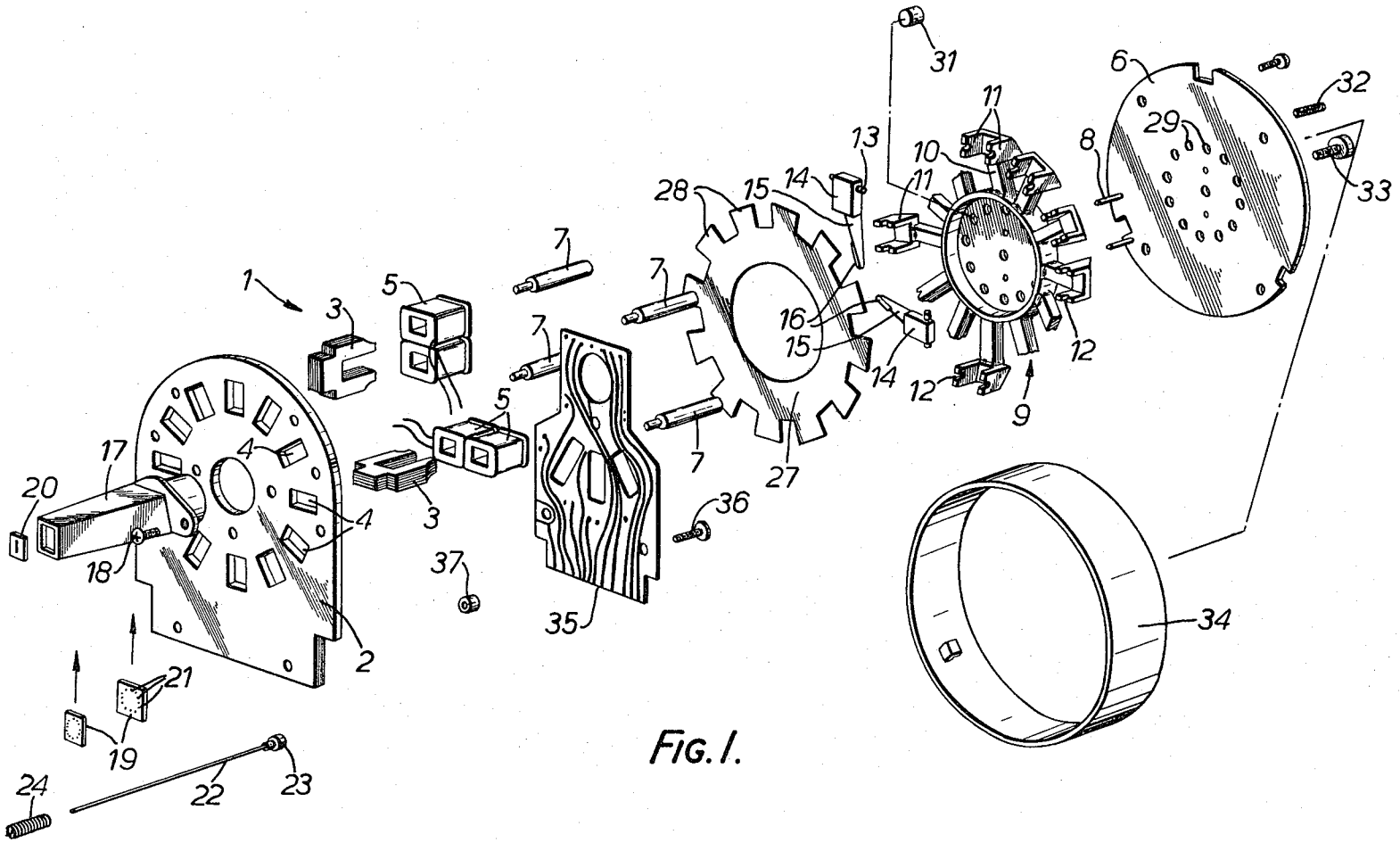

The present invention relates to a wire matrix printing apparatus employing a wire printing head and to a method of selection of wires in the head to print a line of characters.

Wire printers have previously been proposed in which, for example a wire printing head is carried along a print line across a record and in which wires of the head are selected to be driven towards the record in order to print characters in the line. Particular forms of such apparatus have employed a group of wires whose ends are gathered into a single vertical column to form styli facing the record, selected ones of these styli being impelled towards the record at each of a number of predetermined columnar positions forming a character printing area, so that the outline of a required character is progressively formed by dot impressions as the head advances over the character area. The impulsion of each of the styli is derived by the delivery of a blow to the opposite end of the wire, usually by an electromagnet armature, and a convenient form of print head has its electromagnets arranged in a circle at a position adjacent the ends of the printing wires. The selection of the required magnets to be energised is accomplished conventionally by the comparison of a stored character representation with the character required for each character printing area and the consequential selection of the required printing magnets at each of the predetermined columnar positions within this area. Typically a printing head would have seven wires or styli in a column and five columnar positions would be arranged within each character printing area so that a character is represented by a matrix containing $7\times5$ permissible dot printing positions.

When used in conjunction, for example, with data processing apparatus, it is found that as the effective speed of such apparatus is progressively increased, there is a requirement for a corresponding increase in the operating speed of printing apparatus and a primary limitation on the operating speed of previously proposed wire matrix printers is the operating time of the driving electromagnets. The present invention contemplates improvements both in the structure of the printing head and in its mode of operation in printing the characters in order to increase its effective operating speed.

According to the present invention, matrix printing apparatus includes a printing head having a base plate arranged to support a ring of U-shaped yoke assemblies each with a pair of parallel limbs extending in a direction substantially perpendicular to one side of the base plate, the limbs each being arranged to support a coil assembly; means for supporting in spaced relationship substantially parallel to said one side of the base plate a non-magnetic spacer for each yoke assembly overlying the ends of the limbs and a frame having a plurality of fingers, one for each yoke assembly, each carrying a pivot support lug, the disposition of each finger relative to a corresponding one of the yoke assemblies being such as to support an armature pivoted on the lug carried by the respective finger to co-operate with the yoke assembly; a nose piece centrally disposed with respect to the ring of yoke assemblies and arranged to carry wire guides, the nose piece being positioned to project from that side of the base plate opposite said one side; and a plurality of printing wires supported in said wire guides, each wire having a printing end projecting from the nose piece and a second end engageable with and arranged to be impelled in a printing movement by operation of an associated one of the armatures. The frame may include a resilient backstop for the armatures and such a backstop may comprise for each armature a separate adjustable resilient member. The print head may include two columns of printing wires spaced at a pitch of an order of magnitude similar to the wire diameter. Printing wire selection control means may then include provision for regulating the successive selection of a single wire no more frequently than at an interval corresponding to movement of the head along a printing line by a distance at least equal to twice the pitch spacing.

Figure 2:
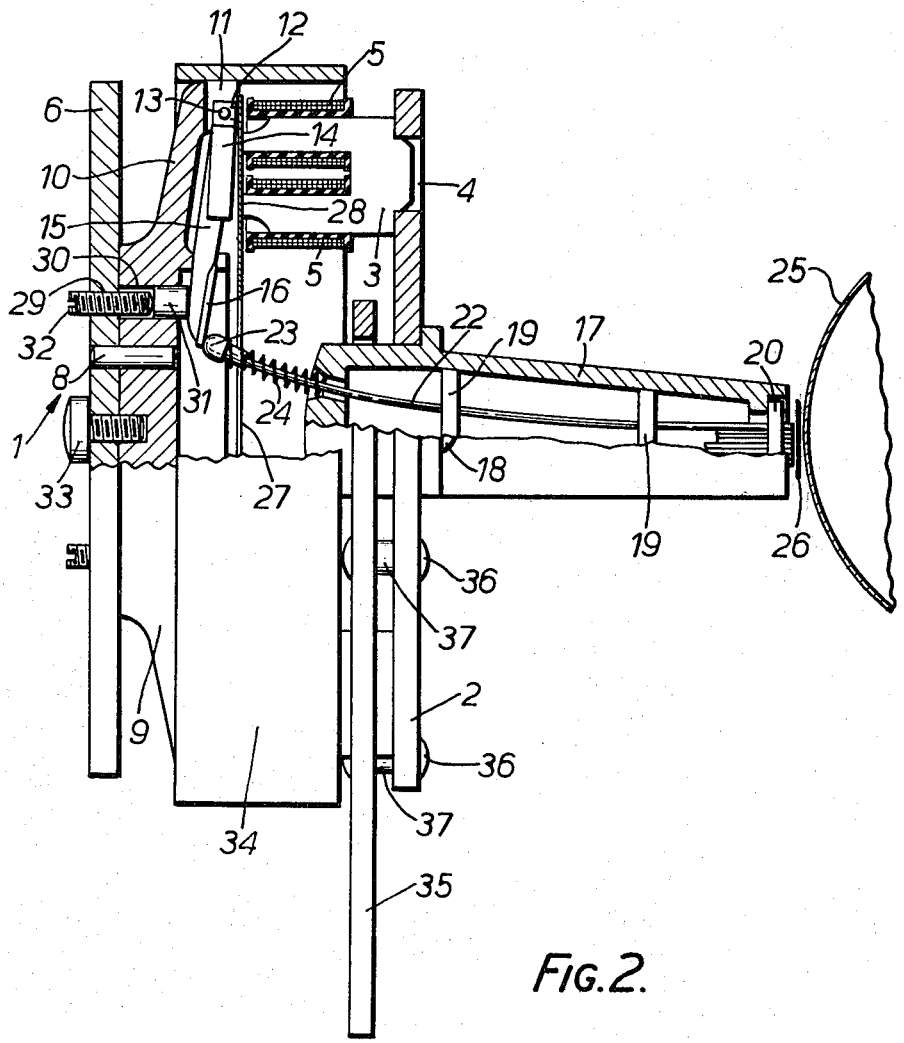
Figure 3:
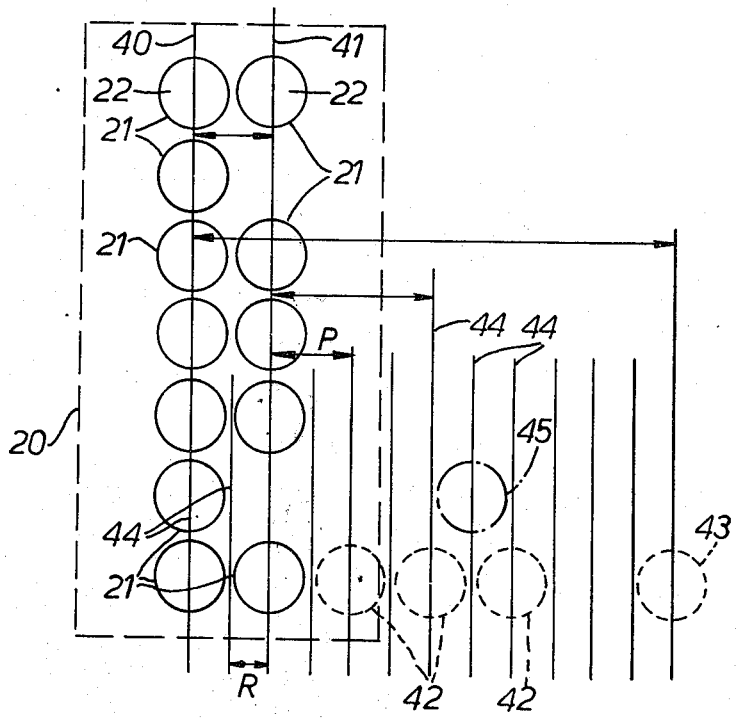
Figure 4:
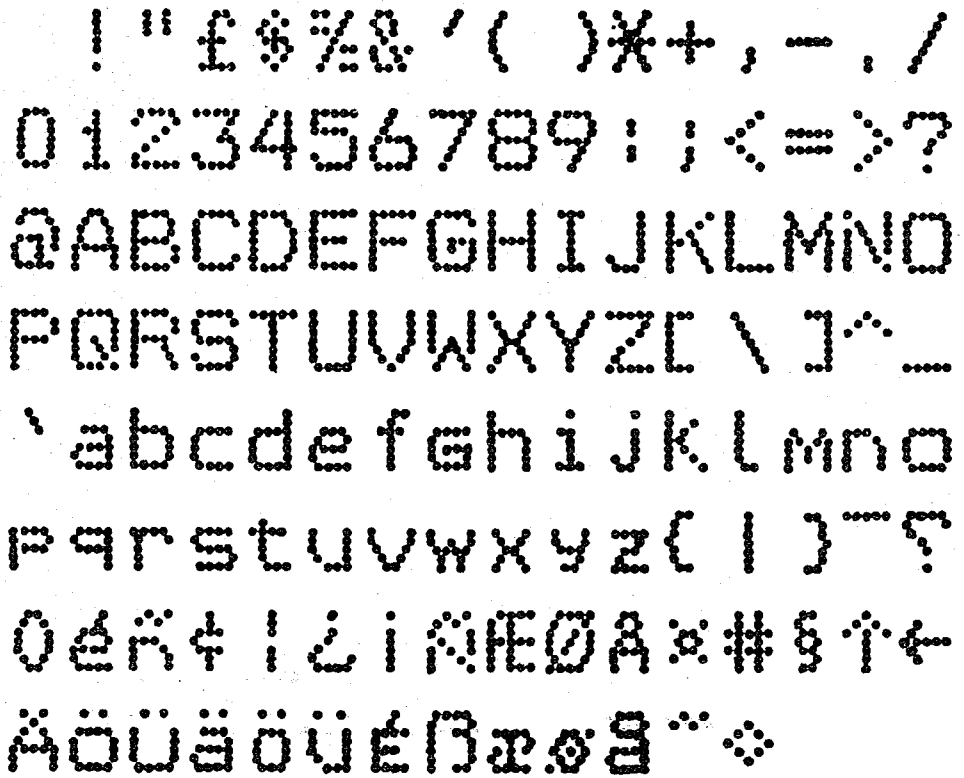

Apparatus embodying the present invention will now be described, by way of example, with reference to the accompanying drawings, in which, FIG. 1 is a diagrammatic exploded view of a printing head, FIG. 2 illustrates, partly in section, an assembled print head, FIG. 3 is an explanatory illustration of the disposition of printing wires forming styli, and FIG. 4 shows an example of the structure of printed characters.

Referring now to FIGS. 1 and 2 of the drawings, a printing head 1 is carried on a main mounting plate 2. The plate 2 carries a number of U-shaped electromagnet yoke assemblies 3, each built up from a number of laminations, the bases of the U-shapes being held in apertures 4 in the plate 2. A coil assembly 5 is positioned on each limb of the yoke assemblies 3. An end plate 6 is spaced away from the main plate 2 by spacers 7 and the plate 6 carries, by means of dowel pins 8, an armature support frame 9. A fixing screw 33 secures the frame 9 to the plate 6. The frame 9 has a number of peripheral fingers 10, one for each yoke 2 and the fingers 10 each have a pair of recessed lugs 11, turned inwardly to face the yokes 3. The recesses 12 in the lugs 11 accommodate projecting pivots 13 of armatures 14, the arrangement of the frame 9 being such that each armature 14 is pivoted against a corresponding one of the yokes 3. Each armature 14 has a projection 15 carrying an ear 16.

A nose piece 17 is secured to the main plate 2 and projects outwards on the opposite side of the plate 2 from the yokes 3, being secured to the plate 2 by screws 18. The nose piece carries a pair of intermediate wire guides 19 and a terminal wire guide 20. The guides 19 and 20 have a number of guide holes 21 for printing wires 22, the terminal guide 20 having its guide holes in a double columnar arrangement, as will be described with reference to FIG. 3, and the intermediate guides 19 have wire guide holes arranged in a suitable configuration to permit the wires 22 to be aligned at one end each with the ear 16 of a corresponding one of the armatures 14, the other ends of the wires 22 projecting from the terminal guide 20.

That end of each wire 22 adjacent the ear 16 of the corresponding armature 14 is fitted with a ferrule 23 which bears against the ear 16 under the influence of a return spring 24, so that the effect of energising the electromagnet coils 5 is to cause the appropriate armature to drive its associated printing wire 22 from its retracted position into a printing position at which it strikes a conventional record member 25 (as best seen in FIG. 2) through a transfer medium such as a printing ribbon 26, to make a mark on the record. Once the coils 5 are de-energised, the return spring 24 restores the wire 22 into its retracted position.

A non-magnetic member 27 is provided, having a projecting ear 28 corresponding to each coil position within the head, each ear 28 being interposed between the ends of the yoke assemblies 3 and the associated armature 14 to provide a conventional residual non-magnetic gap spacer. The end plate 6 is provided with a ring of threaded holes 29 each aligned with a corresponding hole 30 in the armature support frame 9. A resilient plug 31, carried in each of the holes 30, forms a backup damper for each of the armatures. Screws 32 in the holes 29 of the end plate 6 are provided for the adjustment of the dampers 31. The rear of the head assembly is protected by a cover 34. Connections to the coils 5 are conveniently arranged by the use of a printed wiring board 35 which is secured to the main plate 2 by rivets 36 and spacers 37, the board 35 being formed at one edge with connection fingers to receive a suitable socket (not shown).

The arrangement and control of the wires 22 will now be described in greater detail with reference to FIG. 3. As noted earlier, one well-known representation of characters by a stylus—or wire-printer is based on a matrix of dots arranged in a 7×5 configuration, and this configuration will be used as an example to illustrate the operation of the present apparatus. Thus a character may be printed by the selective operation of seven styli arranged in a single column as the column traverses a "five-dot-wide" character space. It is also apparent that to draw a vertical line, all the styli of the column are required to be energised simultaneously, while to draw a horizontal line, a single stylus is required to be operated successively at each of the five notional dot positions of the character space as it is traversed by the head. This latter requirement sets the limitation of printing speed at the maximum rate at which successive dot positions of a horizontal line can be printed by the same stylus.

Thus, given this limitation, it is apparent that in one case, an improvement in printing speed may be obtained by improving the response time for the selection of the styli or printing wires. It is also to be observed that conventional wire printer arrangements have frequently used yoke structures each carrying a single energising coil and, in these cases, the physical size of the coil is a limiting factor in determining the number of wire selection magnets which may be included in a circle of a given size. The size and impedance of such coils also impose severe constraints on the operating characteristics of the wire selection magnets. The form of construction now proposed uses a pair of coils for each electromagnet assembly and this structure permits the reduction of response time of the electromagnet by allowing the application, for example, of an increased electrical current while at the same time allowing greater heat dissipation from the coils so that the entire assembly has an improved performance. At the same time, the physical size of the coils may be reduced so that the provision of the greatest possible number of magnets in a circle becomes a simpler matter.

The arrangement of the printing wires at the terminal guide 20 is indicated in FIG. 3 by a dashed outline representing the guide 20 enclosing the guide holes 21 supporting the wires 22. The wires 22 are arranged in two columns, indicated by column axes 40 and 41. The column 40 contains seven wires 22, while the column 41 contains only five wires 22, one wire 22 being provided at each end of the column 41 as well as a group of three wires 22 occupying adjacent dot positions at the centre of the column. It is found that the omission of wires 22 from the intermediate positions adjacent the ends of the columns does not affect the representation of a satisfactory character outline, and provides a valuable reduction in the required number of wire-operating arrangements, notably the yokes 3, coils 5 and armatures 14 in order to provide a compact print head.

Previous character representations, as has been noted, have required the spacing of the printing wires or styli on a 7×5 matrix grid in which the pitch of the dot positions is the same for rows and columns, adjacent dot positions being at a pitch of the same order as the diameter of the wires, represented in FIG. 3 as a distance P. The extent of a character space is indicated in FIG. 3 by a line of broken outline circles 42 extending from the lowermost pair of guide holes 21 as shown in the Figure. Adjacent character spaces are separated by a space equivalent to one dot position, a broken line circle 43 indicating the first dot position for the next character. For the sake of simplicity, it is preferred to regard the columnar dot-printing positions of the character space as being spaced at half the conventional pitch distance, as indicated by distance R. Thus, the character space consists of nine columnar axes 44 at a pitch spacing R, and the conventional horizontal dot spacing is 2R. Because there are effectively two columns of wires 22 in the printing head, it is possible to use different columns to print dots in adjacent ones of the conventional columnar positions, so that, in the case of a horizontal line, a single wire 22 of one of the columns is required to be actuated at a rate consistent with the movement of the head over a distance 4R. Thus, the former limitation on the printing speed is no longer true, the printing speed being effectively doubled by the use of the present arrangement of printing wires.

Moreover, it is found that the curved appearance of rounded characters may be improved by the selection of horizontal dot positions intermediate those of the conventional matrix, as may be the appearance of angular lines, such as those required for the FIG. "7" or the limbs of such letters as "M" or "K", for example. In order to use these intermediate positions, as shown in the Figure by the position of broken line circle 45, the conventional print control is modified. Previously matrix proposed printers have used a series of timing pulses to control the energization of print magnets, the frequency of the timing pulses being arranged to correspond to the movement of the print head through a distance equal to the spacing between adjacent dot positions, so that the timing pulse corresponds to the time taken for the head to traverse the pitch-distance P. The selection of the particular magnets to be energised at these intervals is dependent upon a stored character representation. In the present case the timing pulse frequency is made to correspond to the time taken by the head to traverse the distance R and the stored character representation then allows the selection of magnet operation at the columnar positions 44 at this pitch. Thus, it will be seen that the control arrangements for the present apparatus are essentially similar to those previously proposed, but that the stored character representation takes into account the altered timing pulse frequency. It will be understood that the over-riding requirement for energisation of the print magnets is that no one magnet may be selected for re-energisation at a frequency greater than that required by the printing head to traverse a horizontal distance equal to 4R, and it will then be apparent that the same magnet may be re-energised for any position lying on one of the column axes 44 once this distance has been equalled or exceeded. FIG. 4 shows a typical set of character representations which may be printed by this arrangement.

It will be realised that the choice of a matrix grid of the size referred to above is one that has been commonly used. It is clear, however, that the provision of seven printing wires in a column is not to be regarded as a necessary limitation on the capacity of the print head 1, and that the horizontal character space illustrated is also exemplary, both the total character space and the columnar axes within that space being determined by the timing pulse frequency in relation to the speed of traversal of the head 1 along the printing line of the record to be printed. Equally, the provision of two columns of printing wires 22 in the printing head is related to the time required for operation of a single print-wire actuator and the speed of head traversal. The omission of two wires from the second column of print wires is convenient where the character outline will permit such a simplification, but is not to be regarded as an essential consequence of the provision of such an additional column.

As has been noted earlier, the example described employs an electromagnet structure having two coils and while this form of construction has advantages in the more efficient operation of the printing wires, it will be realised that a structure using only one coil may alternatively be used. In the interest of close packing of the magnets within the head it is also possible, where two-coil structures arranged in a circle are used, to make the inner coils of smaller diameter than the outer coils.

1. A matrix print head including:

a base plate;

a nose piece secured to the base plate and extending from one face of the base plate;

a first wire guide secured to a first end of the nose piece remote from the base plate;

second wire guides secured to the nose piece intermediate the base plate and said first end;

a plurality of printing wires supported for lengthwise movement by said first and second guides, each printing wire having a printing end projecting from said first end of the nose piece and a ferrule mounted on a second end remote from the printing end;

spring means operating between the ferrules and the nose piece to urge the printing wires to a retracted position;

a plurality of U shaped magnetic yoke assemblies each including a pair of parallel limbs, said yoke assemblies being mounted on said base plate in a ring around a second end of the nose piece remote from said first end with said limbs extending from a second face, opposite said first face, of the base plate;

a pair of coils for each yoke assembly, the coils being mounted one on each limb of the yoke assemblies and electromagnetically coupled thereto;

a plurality of magnetic armatures each provided with a pair of oppositely extending pivots;

a frame including a plurality of radially outwardly extending fingers, one for each magnetic yoke, and having apertures adjacent radially inner ends of the fingers;

a pair of spaced lugs on a radially outer end of each said finger having recesses receiving said pair of pivots of said armatures respectively to pivotally support the armatures for magnetic cooperation one with each magnetic yoke, the armatures extending radially inwards from the pivots and being provided with a projection on radially inner ends thereof engaging one with each ferrule on the printing wires;

a non-magnetic member extending between the armatures and free ends of all the limbs of the magnetic yokes effective upon energisation of said coils to maintain the armatures spaced from the yokes;

a plurality of resilient backstop buffers disposed one in each aperture in the frame for engagement by the armatures when the coils are un-energised and the printing wires are retracted;

and means adjacent the frame mounting adjustment screws engaging the backstop buffers operable to adjust the position of the backstop buffers individually in the frame.

* * * * *